US007138574B1

(12) United States Patent
Spinazzola

(10) Patent No.: US 7,138,574 B1
(45) Date of Patent: Nov. 21, 2006

(54) DRUMHEAD TIGHTENING AND TUNING APPARATUS

(76) Inventor: David M. Spinazzola, 101 Cobblestone La., San Ramon, CA (US) 94583-1755

( * ) Notice: Subject to any disclaimer, the term of this patent is extended or adjusted under 35 U.S.C. 154(b) by 0 days.

(21) Appl. No.: 10/939,098

(22) Filed: Sep. 9, 2004

(51) Int. Cl.
*G10D 13/02* (2006.01)

(52) U.S. Cl. ..... 84/411 R

(58) Field of Classification Search ..... 84/411 R, 84/411 M

See application file for complete search history.

(56) References Cited

U.S. PATENT DOCUMENTS 2,051,671 A 8/1936 Au-Miller
2,115,741 A 5/1938 Newberry
3,541,913 A 11/1970 Severino
4,218,952 A * 8/1980 Arbiter ..... 84/411 A
D339,818 S 9/1993 Peterson
D350,362 S 9/1994 Fujii
5,739,448 A 4/1998 Toscano
6,576,829 B1 * 6/2003 Hart ..... 84/737
6,586,665 B1 7/2003 Liao et al.

* cited by examiner

*Primary Examiner*—Kimberly Lockett

(57) ABSTRACT

An apparatus for tightening a drumhead having a rim and a skin set on a drum body portion. The apparatus utilizes an annular member having a track. A fastener is also employed for holding the annular member relative to the drum body. A retainer is provided and includes a surface for engaging the rim of the drumhead with at least one projection which engages the track of the annular member. The retainer is capable of rotating to move the projection along the track to loosen or tighten the skin of the drumhead through contact with the drum body.

2 Claims, 3 Drawing Sheets

DRUMHEAD TIGHTENING AND TUNING APPARATUS

BACKGROUND OF THE INVENTION

The present invention relates to a novel and useful apparatus for tightening a drumhead.

Drums are tuned or tightened to adjust the pitch of the drum prior to use in an entertainment environment. Generally, the drumhead includes a skin held in contact with a circular rim. The skin bearing on the drum body is normally tightened by adjusting a multiplicity of lug bolts, which are evenly spaced around the exterior of the body. For example, a 12 inch Tom drum generally has 12 adjustment bolts, six on the top and six on the bottom. Each of these bolts must be individually adjusted to provide the proper tuning of the drum, much as one adjusts the spokes on a bicycle wheel. It may be apparent, the tightening of the drum skin produces a higher pitch than a drum which has a loosened skin, the latter producing a lower pitch when struck. Moreover, tightening of one bolt on a conventional drum makes it necessary to loosen one or more of the other bolts in order to "clear" the drumhead to properly tune the drum. Needless to say, tuning a drumhead to produce a desired pitch is time consuming and frustrating.

In the past, systems for tuning drums have been proposed. For example, United States Patents Des. 339,818 and Des. 350,362 show tensioning lug bolts formed on the exterior of a drum which must be individually tightened to adjust the tension of the skin head of the drum.

U.S. Pat. Nos. 2,051,671 and 2,115,741 show tensioning mechanisms for a drum which employ a ratchet mechanism to tighten the skin of the drum and is actuated by an adjusting screw projecting from the drum body.

U.S. Pat. Nos. 4,218,952 and 5,739,448 show drum tensioning devices that employ gears which tighten a counter hoop which tightens the skin of the drum as the gears are rotated.

U.S. Pat. No. 6,586,665 teaches a drum membrane which is adjustable to different tensions which utilizes a tensioning ring that works in conjunction with a bolt or fastener. A follower linked to the adjusting bolt forces a pair of blocks toward and away from one another in order to adjust the tension of the skin head held by the ring.

U.S. Pat. No. 3,541,913 describes a drumhead holding mechanism in which a collar has an adapt flange with a lip that exerts thrust pressure on a hold down ring of the skin that is operated by pneumatic means.

An apparatus for tightening a drumhead of a drum which is reliable and simple to use would be a notable advance in the music field.

BRIEF SUMMARY OF THE INVENTION

In accordance with the present invention a novel and useful apparatus for tightening a drumhead is hereinafter described.

The apparatus of the present invention utilizes an annular member which may be circular. The annular member includes a cam surface track which extends around the drum body. A fastener is also included to hold the annular member relative to the drum body in this regard. The track of the annular member may generally form a spiral which encircles the drum body, similar to a large threaded member.

A retainer or actuator ring is also included in the present invention and may be circular in configuration. The retainer is intended to engage the rim of the drumhead allowing the skin of the drumhead to contact the body of the drum in a conventional manner. The retainer includes a projection which engages the cam or track of the annular member. The retainer rotates relative to the drum body and moves the projection along the track of the annular member. Such movement tightens the skin of the drumhead through its contact with the drum body. The retainer may also be provided with a rotatable ring which contacts the drumhead rim. The rotatable ring may be supported relative the retainer by a bearing structure to reduce friction during the rotation of the retainer.

In addition, in certain aspects of the invention, the projection or cam follower of the retainer may include a rotatable wheel. The rotatable wheel may also include a bearing structure to allow its movement along a track of the annular member.

It may be apparent that a novel and useful apparatus for tightening a drumhead has been hereinabove provided.

It is therefore an object of the present invention to provide an apparatus for tightening a drumhead which is simple and reliable in its use.

Another object of the present invention is to provide an apparatus for tightening a drumhead which is easily retrofitted on a conventional drum body.

A further object of the present invention is to provide an apparatus for tightening a drumhead which accurately adjusts the tuning of a drumhead by a simple rotation of a retainer member.

Yet another object of the present invention is to provide an apparatus for tightening a drumhead which exerts an even tension across the drumhead eliminating areas of looseness or tightness found in the systems of the present invention.

Another object of the present invention is to provide an apparatus for tightening a drumhead which operates in a manner that eliminates damage to portions of the drum body, including a conventional drum hoop.

A further object of the present invention is to provide an apparatus for tightening a drumhead which saves a musician time in adjusting tuning a drum and permits adjustment of a drumhead at any time during a musical performance in a simple and easy manner.

Yet another object of the present invention is to provide an apparatus for tightening a drumhead which is simple to manufacture and install on a conventional drum.

The invention possesses other objects and advantages especially as concerns particular characteristics and features thereof which will become apparent as the specification continues.

For a better understanding of the invention reference is made to the following detailed description of the preferred embodiments thereof which should be taken in conjunction with the prior delineated drawings.

DETAILED DESCRIPTION OF THE PREFERRED EMBODIMENTS OF THE INVENTION

Various aspects of the present invention will evolve from the following detailed description of the preferred embodiments thereof which should be taken in conjunction with the prior described drawings.

Figure 1:
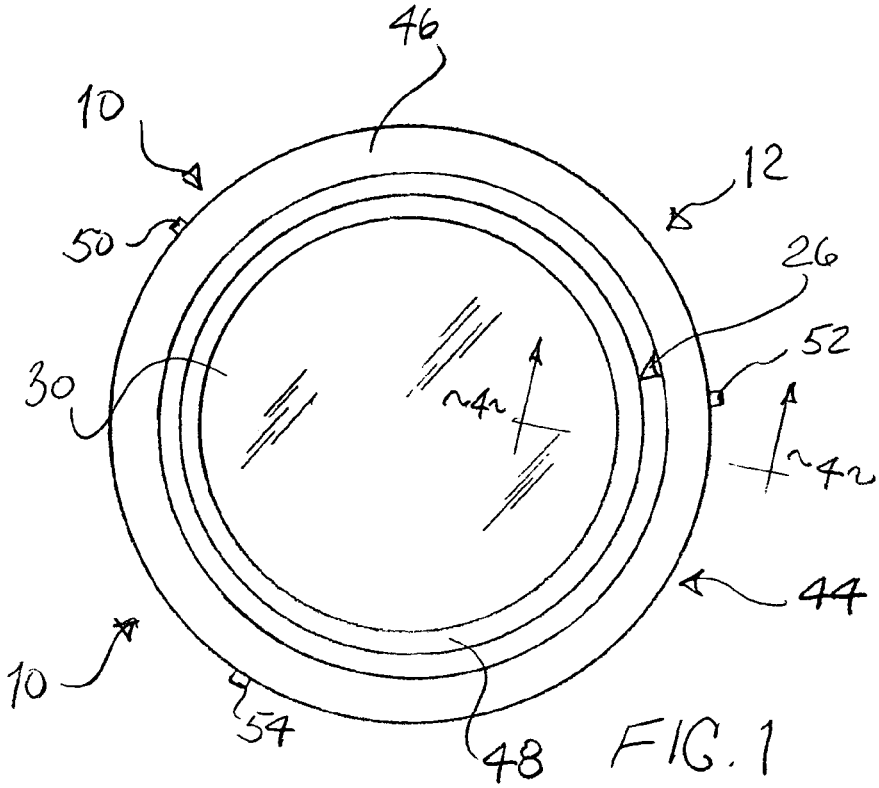
FIG. 1 is a top plan view of the apparatus of the present invention installed on a conventional drum body.
Figure 2:
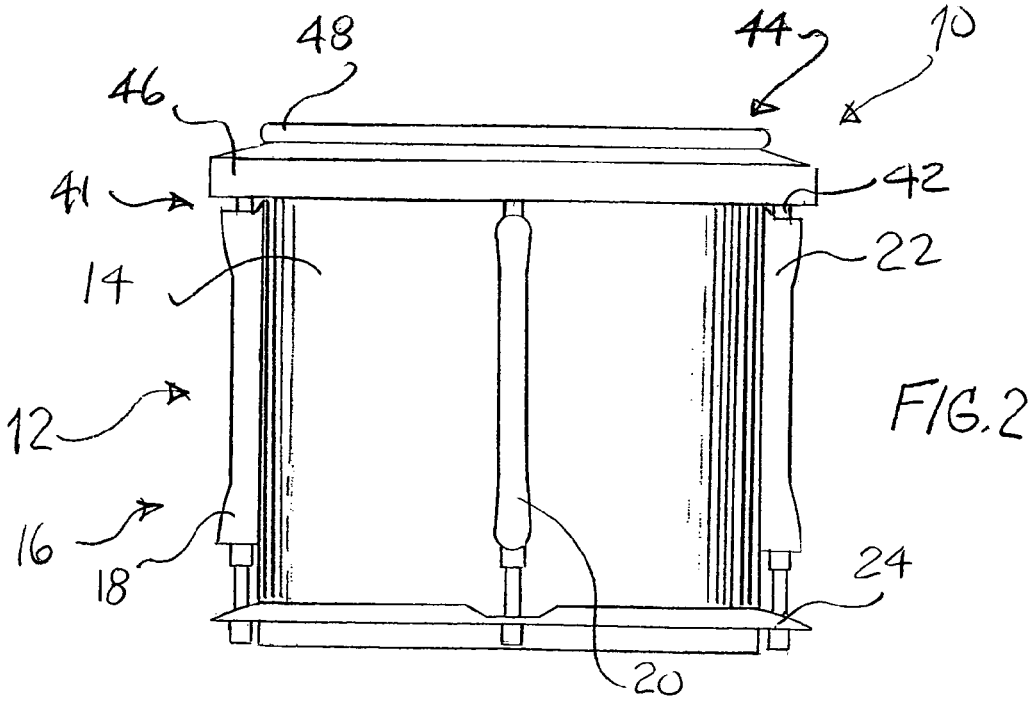
FIG. 2 is a side elevational view of the apparatus of the present invention installed on a conventional drum body.

An embodiment of the invention as a whole is depicted in the drawings by reference character 10. Referring to FIGS. 1 and 2, it may be observed that a drum 12 is shown. Drum 12 possesses a drum body 14 and a multiplicity of tightening lug bolts 16, namely lug bolts 18, 20, and 22. Plurality of lug bolts 16 normally extend from collar 24 to a band or collar (not shown) in a conventional drum. In addition, drum 12 includes a drumhead 26 constructed with a relatively rigid circular rim 28 and a skin 30 held thereby. Drumhead 26 is of conventional configuration, FIGS. 1 and 3. Drum body 14 includes a top rim 32 which is intended to contact skin 30 of drumhead 26 during the tightening process using apparatus 10.

Figure 4:
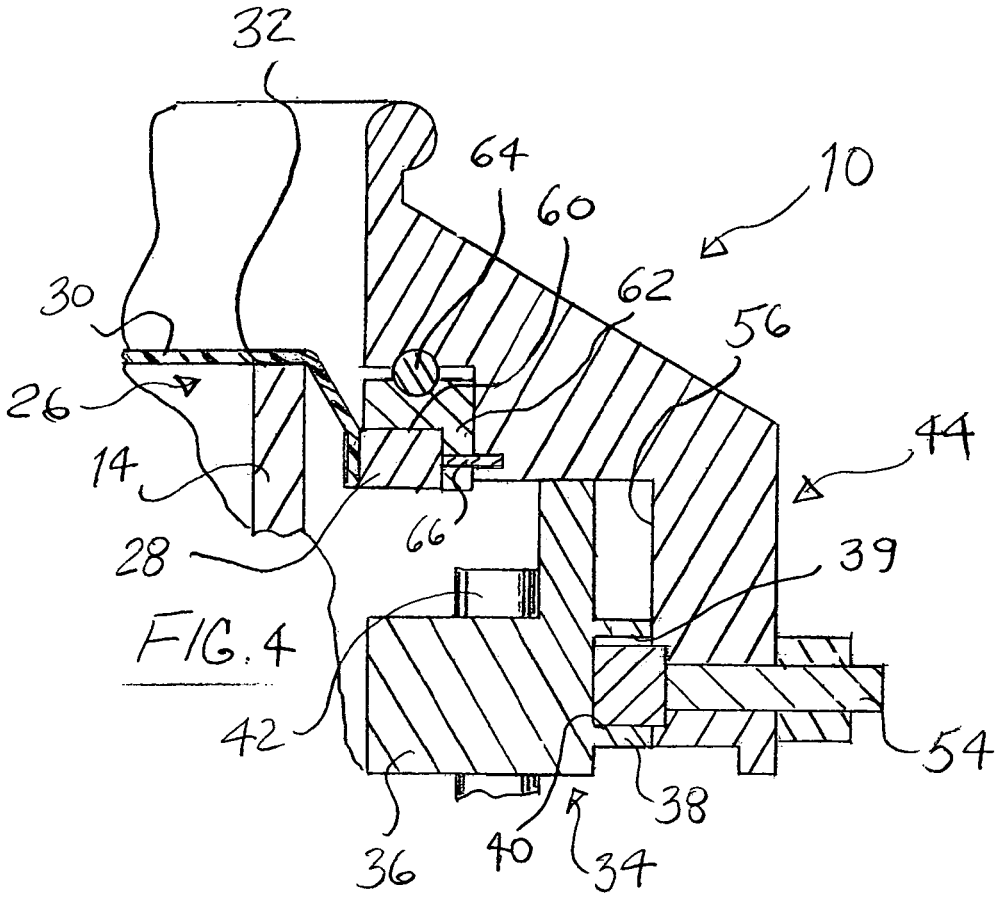
FIG. 4 is a sectional view taken along line 4—4 of FIG. 1.

Apparatus 10 includes as one of its elements an annular member 34. Annular member 34 is generally circular in configuration and extends completely around drum body 14. Annular member 34 is constructed of a body portion 36 and includes a track or ramp, 38 which spirals around annular member body 36. Track 38, thus, possesses cam surfaces 39 or 40, which act as a large threaded member. In certain cases, multiple tracks may be employed with multiple leads. In addition, the pitch of track 38 may be varied as described. Annular member 34 connects to drum 12 through fasteners 41 which is accomplished via plurality of lug bolts 16 that are normally found on drum 12. The termini of lug bolt 16 are fastened to body 36 of annular member 34. Fastener 42, FIG. 4, illustrates the connection of annular member 34 to drum 12 in this regard. Annular member 34 and its track 38 may be formed of any rigid or semi-rigid material such as metal, plastic, and the like.

Figure 3:
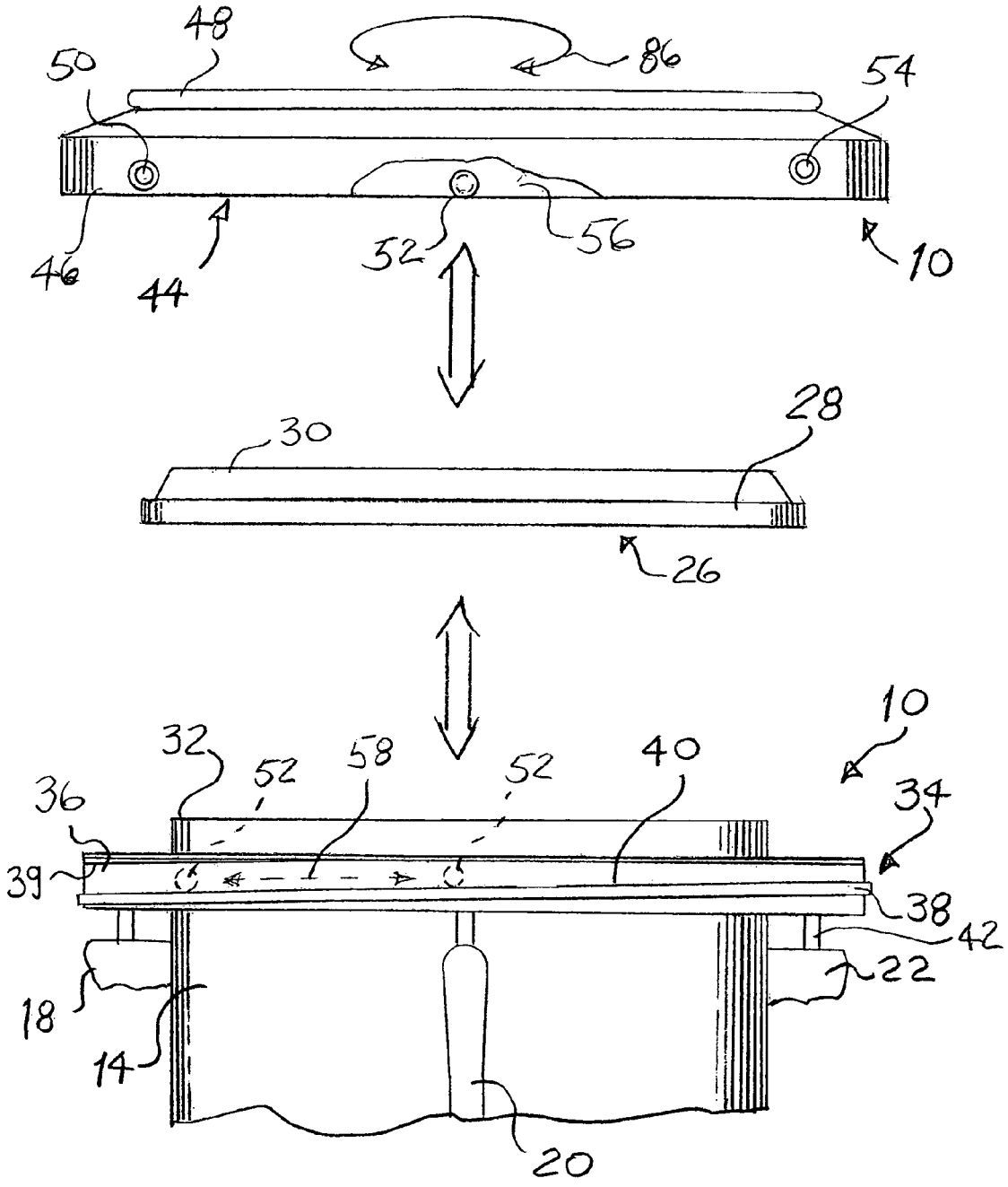
FIG. 3 is an exploded view illustrating the annular member, drumhead unit of conventional configuration, and retainer or rotating actuator ring employed in the apparatus of the present invention.

A retainer or rotating actuator ring 44 having a slightly larger diameter than annular member 34, is also employed in the present invention. Retainer 44 includes a circular body 46 with a rounded crown 48. Projections 50, 52, and 54 extend from inner surface 56 of retainer 44 and are capable of riding on track 38 of annular member 34 as can followers. Projection 52 is depicted in FIG. 3 in phantom on track 38 of annular member 34. Directional arrow 58 indicates the movement of typical projection 52 along cam surfaces 39 or 40 of track 38. Retainer 44 also includes a surface 60 for engaging rim 28 of drumhead 26. As depicted in the embodiment shown in FIG. 4, surface 60 lies on a ring 62 held to retainer 44 and including ball bearing race 64. Of course, such bearings may be formed as roller bearings, needle bearings, or the like. Ring 62 is supported to retainer 44 by wedge 66.

Figure 5:
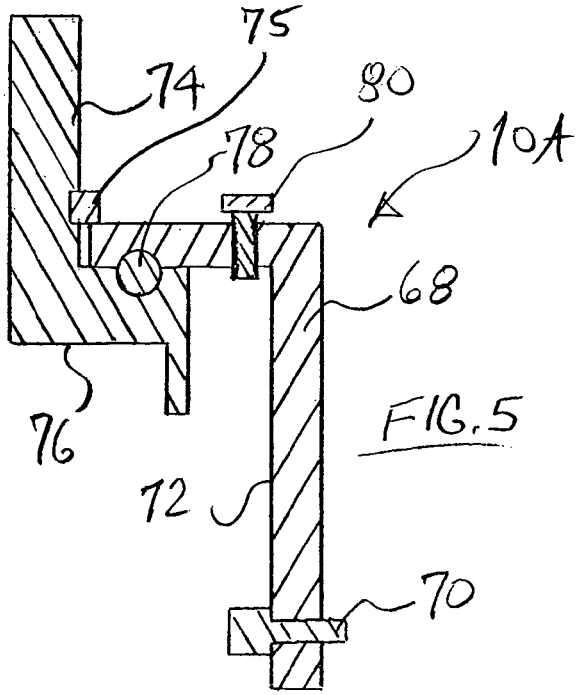
FIG. 5 is a sectional view of an alternate embodiment of the retainer or rotating actuator ring of the present invention.
Figure 6:
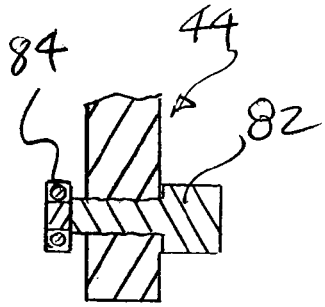
FIG. 6 is a partial sectional view illustrating an alternate embodiment of the retainer projection having a wheel and bearing mechanism for riding on the track of the annular member or cam ring of the present invention.

Turning to FIG. 5, an alternate embodiment 10A of the present invention is depicted. Retainer member 68 is shown with a projection 70 which extends from inner surface 72 thereof. Of course, projection 70 rides on track 38 of annular member 34. Ring member 74 includes a surface which is intended to press against rim 28 of drumhead 26. A snap ring 75 may be used to hold retainer member 68 to ring member 74. Ball bearing race 78 permits the smooth turning of retainer 68 and ring 74 relative to drum 14 since friction is reduced. Drum screw 80 may be employed to lock down the retainer 68 when tuning of drumhead 26 has occurred. FIG. 6 depicts an alternate embodiment of any one of the projections 50, 52, and 54. Projection 82 extends through retainer 44 and terminates in a bearing wheel 84. Of course, wheel 84 is intended to again ride on track 38 as a cam follower, similar to any of the projections 50, 52, and 54.

In operation, the user places drumhead 26 over top rim 32 of drum body 14 of drum 12 in a conventional manner. Retainer 44 is then mated with annular member 34 such that projections 50, 52 and 54 ride initially on surface 40 track 38 and subsequently on surface 39 of track 38 retainer surface 60 presses on ring 62 at this time. Ball bearing race 64 and ring 62 eases the rotation of retainer 44. A clockwise rotation of retainer 38 when viewed from the top, FIG. 1 will tighten skin 30 of drumhead 26 since rim 28 of drumhead 26 is forced downwardly and drum body rim 32 contacts skin 30. This contact eventually forces projections 50, 52 and 54 to shift from cam surface 40 to cam surface 39 during the skin 30 tightening process. Turning of retainer 44 in a counterclockwise direction, FIG. 1, will loosen skin 30 of drumhead 26. Directional arrow 86, FIG. 3, indicates the rotational movement of retainer 44 to either tighten or loosen skin 30 of drumhead 26 atop rim 32 of drum body 14. The retainer depicted in FIG. 5 would work in a likewise manner such that surface 76 of ring 74 would press or bear upon rim 28 of drumhead 26 and achieve the same result. Bearing wheel 84 of alternate embodiment projection 82 shown in FIG. 6 would ride along track 38 of annular member 34 in the same manner of any one of the projections 50, 52, and 54 shown in FIGS. 1–4. In essence, the tightening or loosening of skin 30 tunes a percussion instrument such as drum 12.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A drum tuning system comprised of:

a cylindrical drum body; an annular member, a circular ring where the inside diameter of said annular member is slightly larger in diameter than the outside diameter of said cylindrical drum body, which when attached encircles said cylindrical drum body just below the top of the open end of said cylindrical drum body, said annular member incorporating a single continuous spiraling groove track that starts at the top of said annular member along it's outside diameter continuing in a spiral fashion around the outer circumference of said annular member eventually exiting at the bottom of said annular member, said spiral grooved track forming a single large cam surface;

a larger circular ring assembly made up of two components that fit over and encompass said annular member, the first component being a rotating actuator ring retainer having a larger diameter than the outside diameter of said annular member, and a second component having a smaller inner ring with nearly the same diameter as the rim of the drum head; said rotating actuator ring retainer overlaps and rotates on said inner ring, said inner ring does not rotate but rides on and exerts pressure on the rim of said drum head when fitted over the open end of said cylindrical drum body;

said rotating actuator ring retainer incorporating inward facing projections or rollers on the inside diameter located at opposing intervals and mounted at varied heights to compensate for the angle or pitch of said spiral groove cam track of said annular member, said angle or pitch of said spiral groove cam track being responsible for the camming action created as said projections or rollers on said rotating actuator ring retainer engage said annular member's spiral groove cam track during rotation, the compensating height of said projections or rollers constructed to keep said rotating actuator ring retainer aligned perpendicular to said drum head rim and open end of said cylindrical drum body; clockwise or counterclockwise rotation of said rotating actuator ring retainer simultaneously and evenly varies the tension or stretching of said drum head, which thereby tunes the drum.

2. A drum tuning system according to claim 1 where said rotating actuator ring retainer and said inner ring are separated by bearings or rollers, to facilitate free rotation as said rotating actuator ring retainer rotates on said inner ring while said projections or rollers engage said annular member with said spiral groove cam track.

* * * * *